US008572979B2

(12) United States Patent
Smith et al.

(10) Patent No.: US 8,572,979 B2
(45) Date of Patent: Nov. 5, 2013

(54) GAS TURBINE COMBUSTOR LINER CAP ASSEMBLY

(75) Inventors: Craig F. Smith, Ashford, CT (US); Hannes A. Alholm, Tolland, CT (US); Jonathan J. Eastwood, Newington, CT (US); Dennis J. Duhamel, Oakdale, CT (US); David A. Burns, West Hartford, CT (US); Claude I. Barnett, Jr., Lebanon, CT (US); Randy J. Danburg, Scotland, CT (US); Jeffrey D. Melman, Scottsdale, AZ (US); David R. Wiley, Jupiter, FL (US); Monica Pacheco-Tougas, Waltham, MA (US)

(73) Assignee: United Technologies Corporation, Hartford, CT (US)

( * ) Notice: Subject to any disclaimer, the term of this patent is extended or adjusted under 35 U.S.C. 154(b) by 721 days.

(21) Appl. No.: 12/822,607

(22) Filed: Jun. 24, 2010

(65) Prior Publication Data

US 2011/0314823 A1 Dec. 29, 2011

(51) Int. Cl.
*F02C 1/00* (2006.01)

(52) U.S. Cl.
USPC ..... 60/740; 60/756

(58) Field of Classification Search
USPC ..... 60/752, 756, 737, 740, 738, 746
See application file for complete search history.

(56) References Cited

U.S. PATENT DOCUMENTS

| | | | | |
|---|---|---|---|---|
| 4,982,570 | A | 1/1991 | Waslo et al. | |
| 5,259,184 | A | 11/1993 | Borkowicz et al. | |
| 5,274,991 | A | 1/1994 | Fitts | |
| 5,357,745 | A | 10/1994 | Probert | |
| 5,685,693 | A | 11/1997 | Sexton et al. | |
| 5,722,230 | A | 3/1998 | Cohen et al. | |
| 5,729,968 | A | 3/1998 | Cohen et al. | |
| 5,924,275 | A | 7/1999 | Cohen et al. | |
| 6,438,959 | B1 | 8/2002 | Dean et al. | |
| 6,467,272 | B1 | 10/2002 | Biondo et al. | |
| 6,923,002 | B2 | 8/2005 | Crawley et al. | |
| 2003/0061815 | A1 * | 4/2003 | Young et al. | 60/748 |
| 2009/0188255 | A1 * | 7/2009 | Green et al. | 60/737 |

OTHER PUBLICATIONS

U.S. Department of Energy—DOE—Fossil Energy: How Turbine Power Plants Work, http://fossil.energy.gov/programs/powersystems/turbines/turbines_howitworks.html, Jul. 8, 2009, 2 pgs.

* cited by examiner

*Primary Examiner* — Gerald L Sung
(74) *Attorney, Agent, or Firm* — Miller, Matthias & Hull LLP

(57) ABSTRACT

A combustor liner cap assembly is provided for use in a multiple fuel nozzle combustor of a gas turbine. The combustor liner cap assembly includes a tube plate having a plurality of fuel nozzle openings and a plurality of open ended premix tubes extending aft from the tube plate. Each premix tube has a forward end having a forward edge, the forward end being received in a corresponding one of the fuel nozzle openings. Each premix tube is secured to the tube plate aft of the forward edge of the forward end of the premix tube, for example, metallurgically bonded, such as by welding or brazing, to the tube plate or threaded into the tube plate.

19 Claims, 5 Drawing Sheets

GAS TURBINE COMBUSTOR LINER CAP ASSEMBLY

FIELD OF THE INVENTION

This invention relates generally to industrial gas turbines and, more particularly, to multi-nozzle combustors for industrial gas turbines.

BACKGROUND OF THE INVENTION

Industrial gas turbines generally include a compressor, a combustion system and a turbine. The combustion system commonly includes a plurality of combustors disposed at circumferentially spaced intervals in a ring about the periphery of the gas turbine. In each combustor, liquid or gas fuel is combusted in high pressure air delivered by the compressor to produce high temperature, high pressure combustion gases. A transition duct connects the outlet end of each combustor to the inlet end of the turbine whereby the high temperature, high pressure combustion gases formed in the various combustors are delivered to the turbine. The turbine is driven in rotation as the high temperature, high pressure combustion gases expand in passing over the turbine blades. The turbine drives the compressor and, in power plant applications, also drives a generator to produce electricity.

Combustors used in industrial gas turbines of this type typically include multiple fuel nozzles, generally five or six arrayed in a circular ring pattern. In some embodiments, an additional fuel nozzle is disposed centrally within the ring of fuel nozzles and along a central axis of the combustor. The combustor includes a generally cylindrical outer casing extending longitudinally about a central axis from a forward end to an aft end in gas flow communication with the turbine. A generally cylindrical combustor liner, which circumscribes and defines the combustion chamber, is disposed coaxially within a generally cylindrical flow sleeve that is coaxially disposed within the outer casing of the combustor. A combustor liner cap assembly is disposed coaxially at the forward end of the combustor liner to form the closed forward end of the combustor liner and is fixed to the outer casing of the combustor.

The combustor liner cap assembly conventionally includes a generally cylindrical sleeve secured to a base plate and extending longitudinally to an aft plate disposed at the aft end of the combustor liner. The forward plate is a generally cylindrical plate having a plurality of nozzle openings, one for each fuel nozzle assembly. An open-ended cylindrical premix tube extends aftward from each of the nozzle openings. Additionally, a plurality of collar-like nozzle guides, one per nozzle opening, are disposed about the nozzle openings of the face of the base plate.

The construction of the combustor liner cap assembly must allow for differential thermal expansion at the downstream end of premix tubes and at the same time provide a structurally sound attachment of the premix tubes to the combustor structure. Further, the nozzle guides must be retained in place against the face of the base plate in a "floating" relationship that permits slight adjustment relative to the nozzle openings to accommodate insertion of a fuel nozzle assembly through the nozzle guide and into the associated premix tube. The conventional construction of the combustor liner cap assembly could be improved to be more cost-effective and less labor intensive, while maintaining, if not improving, the construction of the combustor liner cap assembly with respect to the afore-mentioned criteria.

SUMMARY OF THE INVENTION

A combustor liner cap assembly is provided for use in a multiple fuel nozzle combustor of a gas turbine. The combustor liner cap assembly includes a tube plate having a plurality of fuel nozzle openings and a plurality of open ended premix tubes. Each premix tube has a forward end having a forward edge and is secured to the tube plate aft of the forward edge of the forward end of the premix tube. For example, each premix tube may be metallurgically bonded, such as by welding or brazing to the tube sheet, or threaded to the tube sheet, aft of the forward edge of the forward end of the premix tube. The combustor liner cap assembly includes a substantially cylindrical, longitudinally extending sleeve having a forward end and an aft end, with the tube plate fixed to the forward end of the sleeve and an aft plate fixed to the aft end of the sleeve. The aft end plate has a plurality of fuel nozzle openings, each fuel nozzle opening receiving in a sliding relationship an aft end of a corresponding one of the plurality of premix tubes.

In an embodiment of the combustor liner cap assembly, the forward end of each premix tube is received in a corresponding one of the fuel nozzle openings so as to extend beyond a forward face of the tube plate. Additionally, each premix tube includes a radial flange extending about the forward end of the premix tube, the radial flange having a face surface flush with a face surface of the premix tube and an under surface. The forward end of the each premix tube extends beyond the forward face of the tube plate by a distance of at least about 12.7 millimeters (about 0.5 inch) as measured from the under surface of the radial flange of the premix tube to the forward face of the tube plate. The forward end of each premix tube extend beyond the forward face of the tube plate by a distance ranging from about 12.7 millimeters (about 0.5 inch) to about 25.4 millimeters (about 1.0 inch) as measured from the under surface of the radial flange of the premix tube to the forward face of the tube plate. The combustor liner cap assembly further includes a plurality of open-ended nozzle guides, each nozzle guide having a first end having a radial flange, with the first end of each nozzle guide assembled in floating relationship in abutment with a corresponding one of the plurality of premix tubes. A plurality of retaining members may be associated with each premix tube and nozzle guide assembly, each retaining member having a longitudinally extending leg mounted to the radial flange on the forward end of the premix tube and a tip flange extending radially over the radial flange of nozzle guide assembly.

In an embodiment of the combustor liner cap assembly, the tube plate includes a plurality of first countersunk surfaces in the forward face, each first countersunk surface surrounding a corresponding one of the plurality of fuel nozzle openings, and a plurality of second countersunk surfaces, each second countersunk surface formed within a corresponding one of the plurality of first countersunk surfaces and surrounding a corresponding one of the plurality of fuel nozzle openings. Each premix tube is received in a corresponding one of the fuel nozzle openings and disposed with its forward edge flush with the first countersunk surface in the forward face of the tube plate. Each premix tube is brazed to the tube plate at an interface of the premix tube and the tube plate about the second countersink surface. Each of the plurality of second countersunk surfaces may be formed with a chamfer relative to a corresponding one of the plurality of the first countersunk surfaces.

BRIEF DESCRIPTION OF THE DRAWINGS

For a further understanding of the disclosure, reference will be made to the following detailed description which is to be read in connection with the accompanying drawing, where.

DETAILED DESCRIPTION OF THE INVENTION

Figure 1:
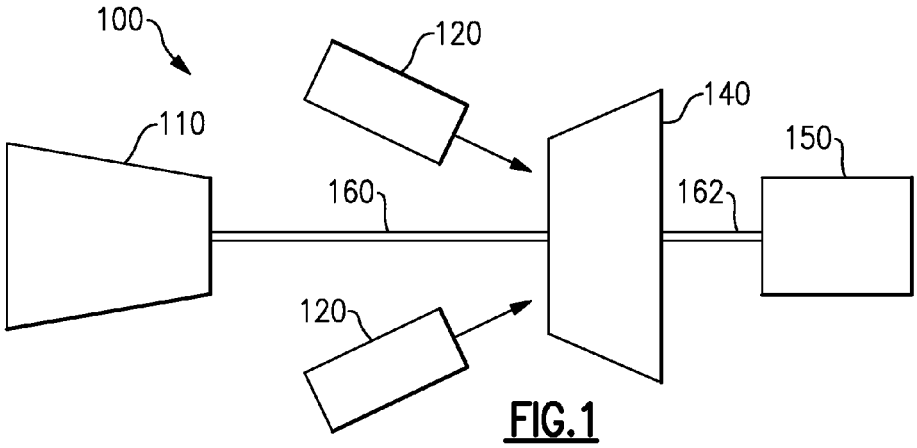
FIG. 1 is a schematic diagram depicting an exemplary embodiment of an industrial gas turbine.

Referring initially to FIG. 1, there is depicted an industrial gas turbine 100 of the type typically employed in land-based installations for industrial uses, such as, but not limited to, power generation. The industrial gas turbine 100 includes a compressor 110, a plurality of combustors 120, a turbine 140. A shaft 160 connects the turbine 140 to the compressor 110 whereby the turbine 140 drives the compressor 110. In power generation applications, the turbine 140 is also connected by a shaft 162 to an electric generator 150 to also drive the generator for generating electricity. The plurality of combustors 120 are arrayed about the gas turbine with each combustor 120 being connected by a transition duct to deliver hot, high velocity combustion product gases into the turbine 140.

Figure 2:
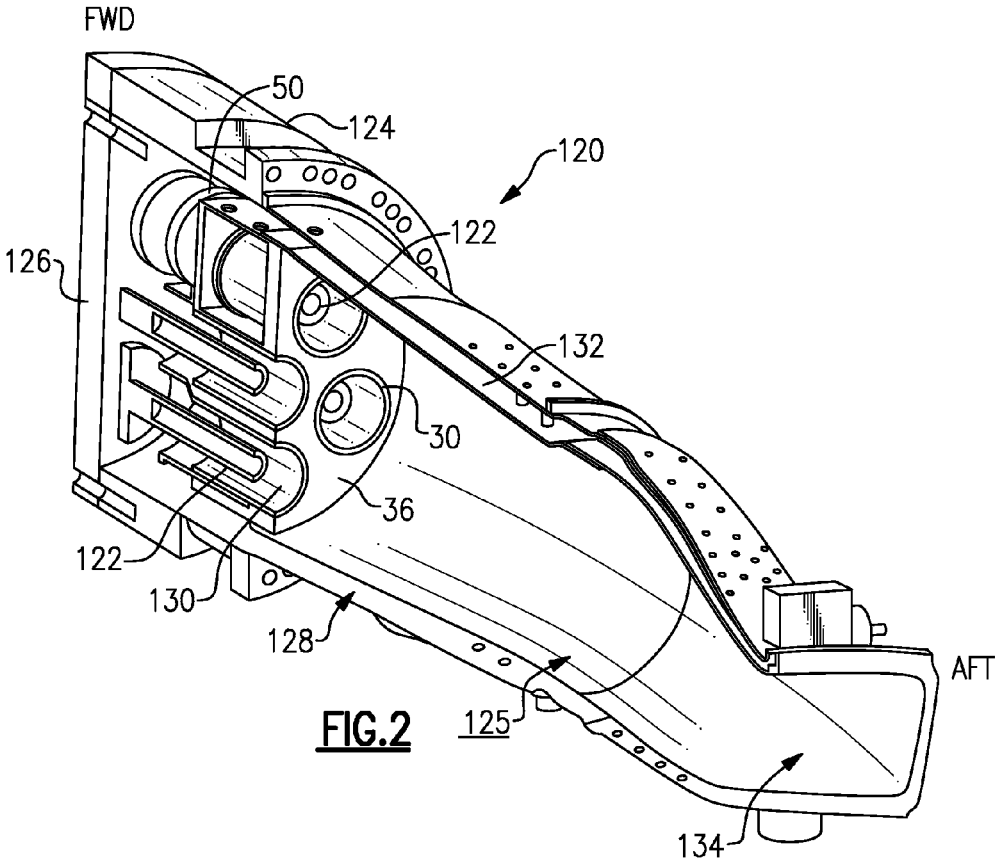
FIG. 2 is a perspective view, partly in section, of an exemplary embodiment of a combustor for use in an industrial gas turbine.

In industrial gas turbines of this type, the combustors 120 typically include multiple fuel nozzles 122, generally five or six arrayed in a circular ring pattern, as illustrated in FIG. 2. An additional fuel nozzle 122 may be disposed centrally within the ring of fuel nozzles and along a central axis of the combustor 120. The combustor 120 includes a longitudinally extending, generally cylindrical outer casing 124, of which only the forward section thereof is depicted in FIG. 2, an end cover 126, a combustor liner 128, a combustor liner cap assembly 130, a flow sleeve 132 and a transition piece 134. The end cover 126 closes the forward end of the combustor 120 and supports the plurality of fuel nozzles 122. The generally cylindrical combustor liner 128, which circumscribes and defines the combustion chamber 125, is disposed coaxially within a generally cylindrical flow sleeve 132 that is coaxially disposed within the outer casing 124 of the combustor 120. The combustor liner cap assembly 130 is disposed coaxially at the forward end of the combustor liner 128 and is fixed to the outer casing 124 of the combustor 120. The transition piece 134 connects at its forward end to the aft end of the combustor liner 128 and opens at its aft end in fluid communication to the inlet of the turbine 140, thereby defining a flow path through which the hot combustion product gases pass from the combustion chamber 125 into the turbine 140.

Figure 3:
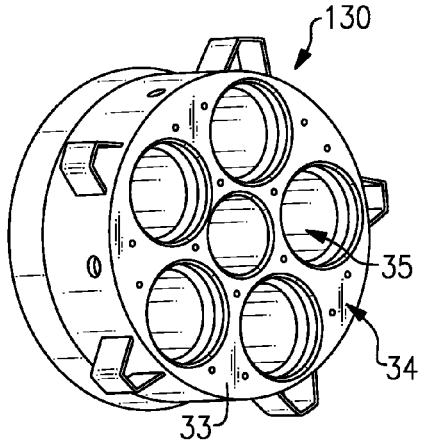
FIG. 3 is a perspective view of an exemplary embodiment of a combustor liner cap assembly viewing the forward end of the combustor liner cap assembly.
Figure 4:
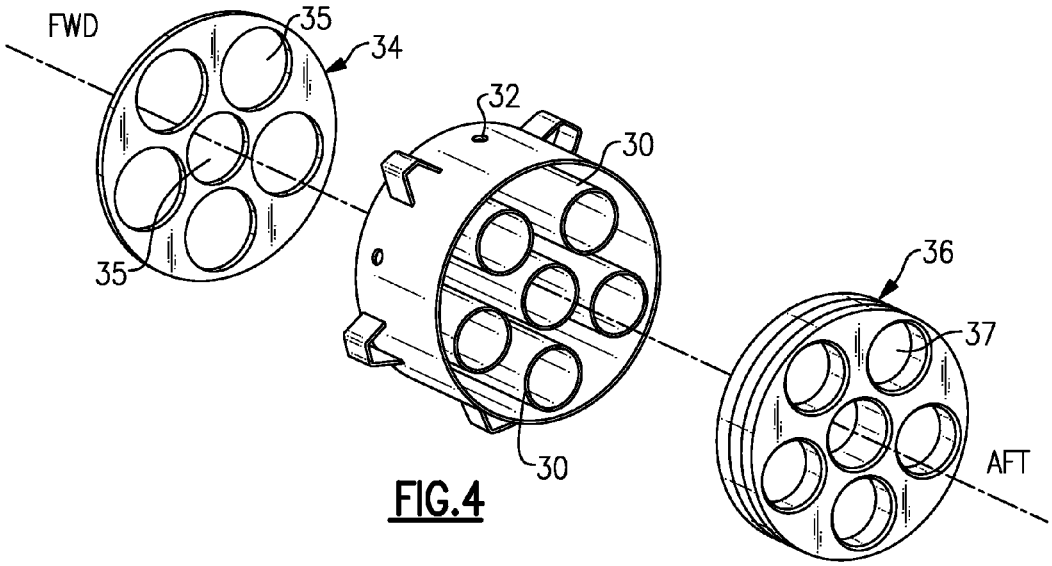
FIG. 4 is a perspective view, partially exploded, of the combustor liner cap assembly of FIG. 3 viewing from aft of the combustor liner cap assembly.

Referring now to FIG. 2-4, the combustor liner cap assembly 130 includes a plurality of open ended premix tubes 30 extending longitudinally within generally cylindrical outer sleeve 32. The plurality of premix tubes 30 is equal in number to the plurality of fuel nozzles 122 present. Each premix tube 30 has a forward end 31 having a forward edge 37 that is generally annular in shape and faces axially outward with respect to the premix tube 30, as best seen in FIGS. 6, 7, 9-11, 13. The forward edges 37 of the respective premix tubes 30 do not contact the tube plate 34. Each premix tube 30 extends between a tube plate 34 at the forward end 31 of the combustor liner cap assembly 130 and an aft end plate 36 disposed at the aft end of the combustor liner cap assembly 130. The tube plate 34 is mounted to the forward end 31 of the outer sleeve 32 and the aft end plate 36 is mounted to the aft end of the outer sleeve 32. A plurality of nozzle guides 50 are provided on the forward side of the tube plate 34, each nozzle guide 50 associated with a corresponding one of the nozzle openings 35. In assembly of the combustor 120, each of the fuel nozzles 122, which extend through the end cover 126, is received into a corresponding one of the nozzle guides 50 and directed into a corresponding one of the premix tubes 30.

The tube plate 34 is a generally cylindrical plate having a plurality of nozzle openings 35 passing there through, the nozzle openings 35 being equal in number to the number of premix tubes. The fuel nozzle openings 35 may be arrayed in a circular ring about a single centrally disposed fuel nozzle opening 35, such as shown in the depicted embodiment. The forward end 31 of each premix tube 30 is received within a corresponding one of the nozzle openings 35 in the tube plate 34 and, as will be discussed in further detail herein later, secured to the tube plate 34 at a location away from the forward edge 37 of the premix tube 30. The aft end of each premix tube 30 is received in a corresponding one of plurality of nozzle openings 37 in the aft end plate 36 in a non-fixed, sliding fit relationship to the aft end plate 36.

Figure 5:
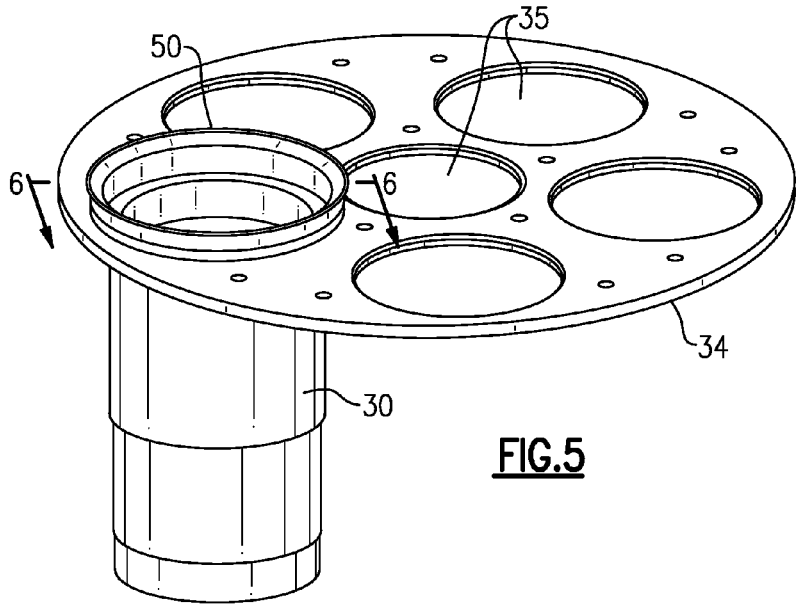
FIG. 5 is a perspective view illustrating one embodiment of a premix tube and tube plate assembly of the combustor liner cap assembly of the invention.
Figure 6:
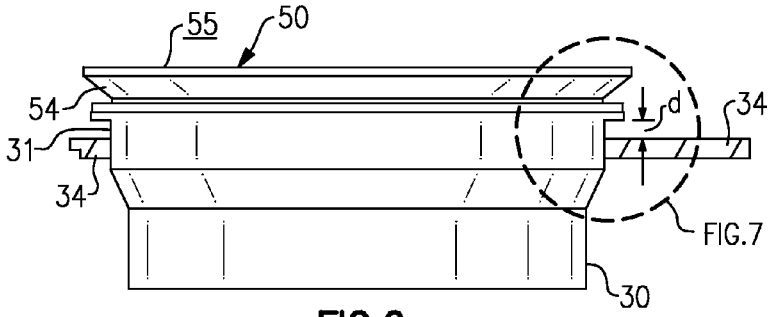
FIG. 6 is a sectioned side elevation view taken along line 6-6 of FIG. 5.
Figure 7:
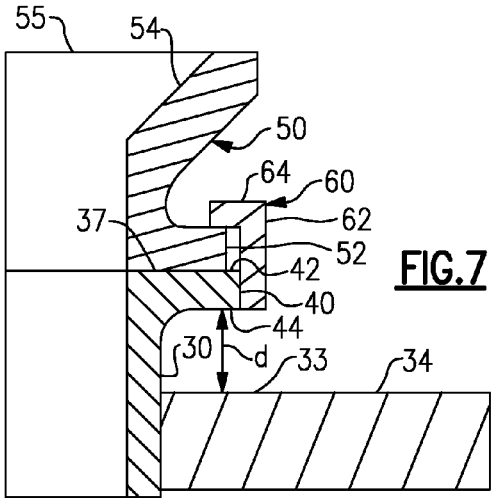
FIG. 7 is an enlarged side elevation view, in section, of a portion of FIG. 6.

Referring now to FIGS. 5-7, there is depicted an embodiment of a premix tube 30, nozzle guide 50 and tube plate 34 assembly. For purposes of simplifying the illustration, only one premix tube 30 is shown, but it is to be understood that there are actually six premix tubes 30 associated with the tube plate 34, one premix tube 30 per nozzle opening 35. Additionally, a plurality of nozzle guides 50 are provided, with one nozzle guide 50 associated with a corresponding one of the premix tubes 30.

As best seen in FIGS. 6 and 7, in this particular embodiment, the premix tube 30 is received within the nozzle opening 35 with the forward end 31 of the premix tube 30 extending beyond the forward face 33 of the tube plate 34. Additionally, the forward end 31 of the premix tube 30 includes a circumferentially extending, radially directed flange 40 having a face surface 42 and an under surface 44. With the forward end 31 of the premix tube 30 extending beyond the forward face 33 of the tube plate 34, the under surface 44 of the flange 40 is spaced by a distance, d, from the forward face 33 of the tube plate 34. The distance, d, should be at least about 12.7 millimeters (about 0.5 inch), and may range from about 12.7 millimeters (about 0.5 inch) to about 25.4 millimeters (about 1.0 inch). The premix tube 30 is secured to the tube plate 34 by a metallurgical bond, for example by welding or brazing, at the interface of the premix tube 30 with the tube plate 34, which with the forward end 31 of the premix tube extending beyond the forward face 33 of the tube plate 34 is aft of the forward edge 37 of the forward end 31 of the premix tube 30. The forward edge 37 of the premix tube 30 does not contact the tube plate 34.

The nozzle guide 50 comprises an annular collar having a radially outwardly directed, circumferentially extending base flange 52 at a first end of the collar and an outwardly flared guide flange 54 defining a mouth 55 for guiding a fuel nozzle 122 into the premix tube 30 at an opposite end of the collar. The base flange 52 of the nozzle guide 50 is supported on the face surface 42 of the flange 40 on the forward end 31 of the premix tube 30. The nozzle guide 50 is retained by means of a plurality of retaining members 60, typically three in number, spaced at intervals about the circumference of the flange 40. As illustrated in FIG. 7, each retaining member 60 may comprise an inverted L-shaped member having a longitudinally extending leg 62 welded at its distal end to the flange 40 on the forward end 31 of the premix tube 30 and having a tip flange 64 extending inwardly from the proximal end of the leg 62. The tip flange 64 extends inwardly over the base flange 52 on the nozzle guide 50 thereby retaining the nozzle guide 50 in position on the face surface 42 of the flange 40 on the forward end 31 of the premix tube 30, but permitting the nozzle guide 50 a limited freedom of sliding movement relative to the associated premix tube 30.

Figure 8:
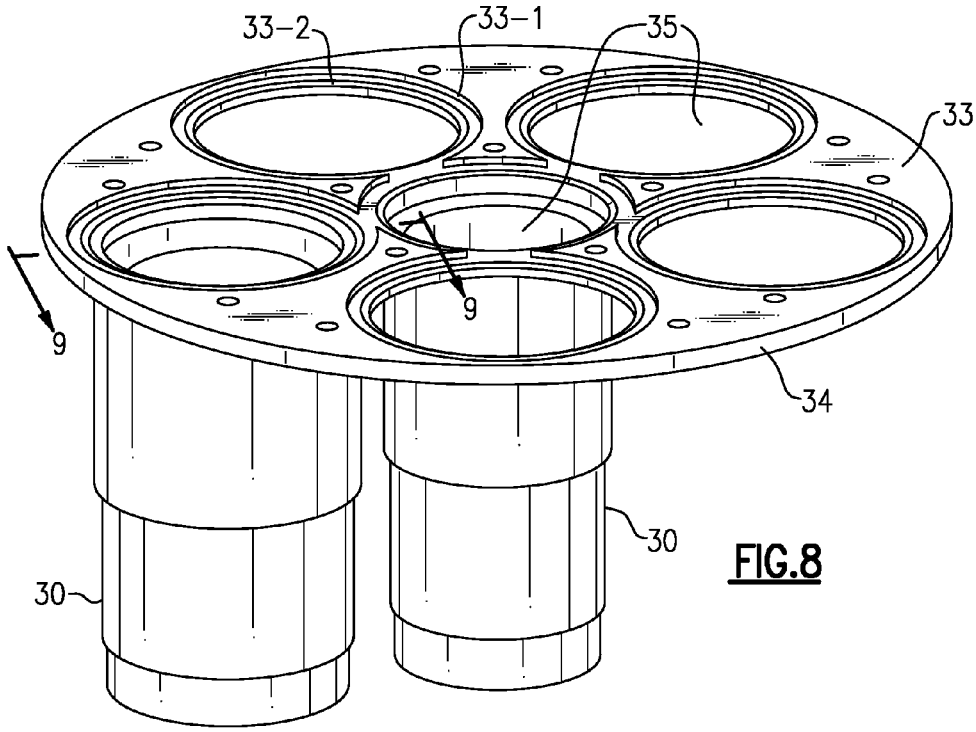
FIG. 8 is a perspective view illustrating another embodiment of a premix tube and tube plate assembly of the combustor liner cap assembly of the invention.
Figure 9:
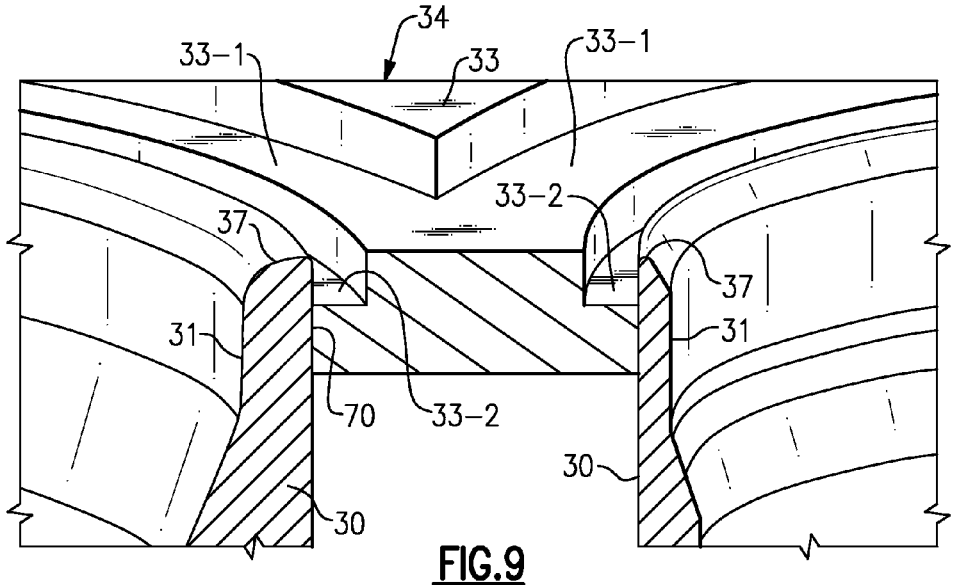
FIG. 9 is a sectioned side perspective view taken substantially along line 9-9 of FIG. 8 illustrating a first arrangement for joining the premix tubes to the tube plate.
Figure 10:
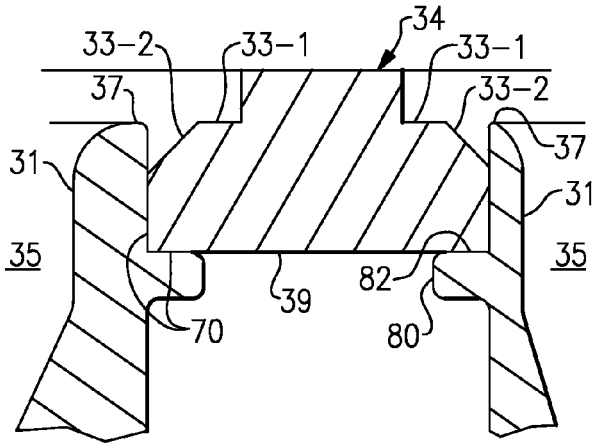
FIG. 10 is a sectioned side elevation view taken along line 9-9 of FIG. 8 illustrating a second arrangement for securing the premix tubes to the tube plate.

Referring now to FIGS. 8-10, there is depicted another embodiment of a premix tube 30 and tube plate 34 assembly. For purposes of simplifying the illustration, only two premix tubes 30 are shown, the central premix tube and one outer premix tube, but it is to be understood that there are actually six premix tubes 30 associated with the tube plate 34, one premix tube 30 per nozzle opening 35. The tube plate 30, in addition to having a plurality of fuel nozzle openings, includes a plurality of first countersunk surfaces 33-1 in the forward face 33 and a plurality of second countersunk surfaces 33-2 in the forward face 33. Each of the first countersunk surfaces 33-1 surrounds a corresponding one of the plurality of fuel nozzle openings 35. Each of the second countersunk surfaces 33-2 is formed within a corresponding one of the plurality of first countersunk surfaces 33-1 and surrounds a corresponding one of the plurality of fuel nozzle openings 35.

As best seen in FIGS. 9 and 10, each premix tube 30 is received within the nozzle opening 35 with the forward end 31 of the premix tube extending beyond the second countersunk surface 33-2 and the forward edge 37 of the forward end 31 of the premix tube being substantially flush with the first countersunk surface 33-1. Each premix tube 30 is brazed to the tube plate 34, the braze joint 70 being extending along the interface of the premix tube 30 and the tube plate 34 about the portion of the nozzle opening 35 extending between the aft face 39 of the tube plate 34 and the second countersink surface 33-2. The second countersunk surface 33-2 may be parallel to the first countersunk surface 33-1, such as, for example, as depicted in FIG. 9, or may be formed as a chamfer extending downwardly at an angle from the first countersunk surface 33-1 to intersect the nozzle opening 35, such as, for example, depicted in FIG. 10. Each premix tube 30 may also include a radially outward extending lip 80 set back aftwardly from the forward edge 37 of the forward end 31 of the premix tube 30, as illustrated in FIG. 10. When the premix tube 30 is received in the nozzle opening 35, the forward face 82 of the lip 80 abuts the aft face 39 of the tube plate 34. With the lip 80, the braze joint 70 between the premix tube 30 and the tube plate 34 extends into the interface between the forward face 82 of the lip 80 and the aft face 39 of the tube plate 34. Additionally, the lips 80 may be located relative to the forward edge 37 of the forward end 31 of the premix tube 30 so as to ensure that when the premix tube 30 is received in the nozzle opening 35 with the forward face 82 of the lip 80 abutting the aft face 39 of the tube plate 34, the forward edge 37 of the forward end 31 of the premix tube 30 is positioned flush with the first countersunk surface 33-1 in the forward face 33 of the tube plate 34. The forward edge 37 of the premix tube 30 does not contact the tube plate 34.

Figure 12:
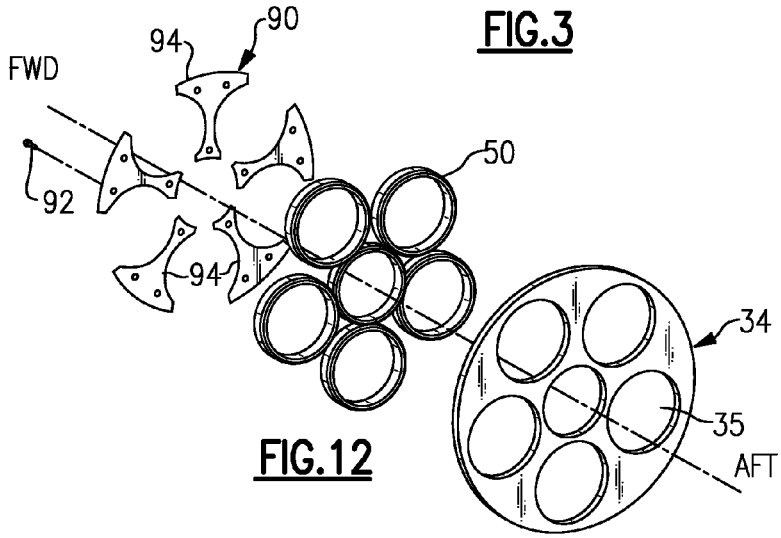
FIG. 12 is an exploded prospective view illustrating an arrangement for retaining the nozzle guides in position on the combustor liner cap assembly of FIG. 8.
Figure 11:
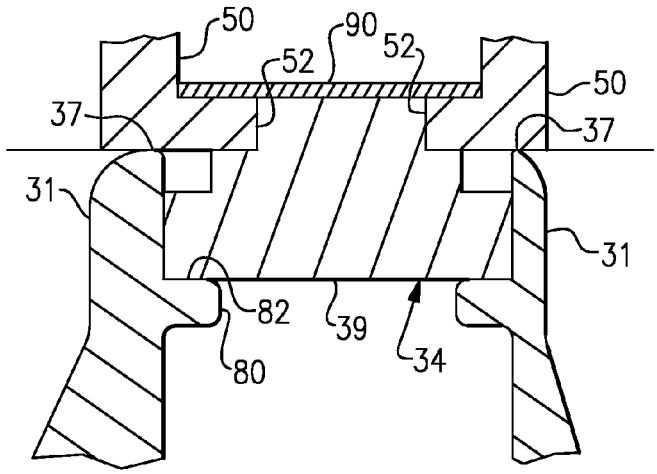
FIG. 11 is a sectioned side elevation view of the combustion liner cap assembly of FIG. 9 with nozzle guides included.

As with the embodiment depicted in FIGS. 5-7 and described previously, a plurality of nozzle guides 50 are provided on the premix tube and tube plate assembly depicted in FIGS. 8-10, with one nozzle guide 50 associated with a corresponding one of the premix tubes 30. Referring now to FIGS. 11 and 12, the base flange 52 of the nozzle guide 50 is supported in floating relationship on the first countersunk 33-1. That is, the outside diameter of the first countersunk surface 33-1 is slightly larger than the outside diameter of the base flange 52 of the nozzle guide 50 thereby permitting the nozzle guide 50 a limited freedom of sliding movement relative to the associated premix tube 30. A retainer plate 90 is secured to the forward face 33 of the tube plate 34, such as, for example, by bolts 92 screwed into threaded holes in the tube plate 34, to hold the base flanges 52 of the nozzle guides 50 in position. As illustrated in FIG. 12, the retainer plate 90 may be comprised of a plurality of plate sectors 94, one plate sector 94 positioned and secured to the tube plate 34 between a corresponding pair of nozzle guides 50. Each sector plate overlaps a portion of the base flange 52 of each of the nozzle guides 50 supported on the first countersunk surface 33-1 of the corresponding outer nozzle openings 35, as well as a portion of the base flange 52 of the single central nozzle guide 50.

Figure 13:
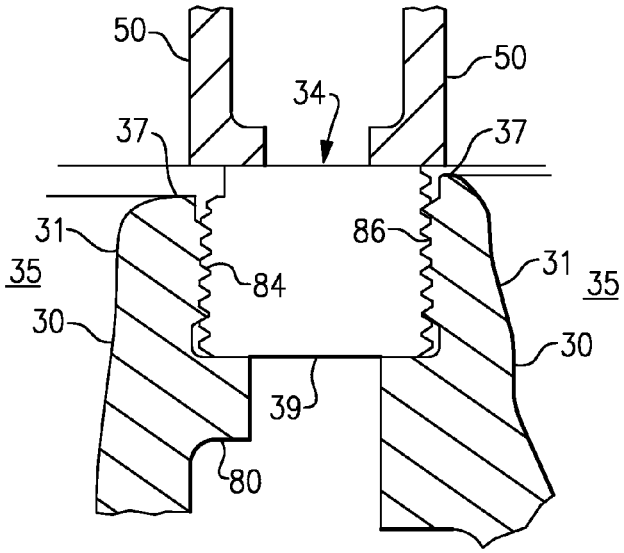
FIG. 13 is a sectioned side elevation view of an arrangement wherein the premix tubes are secured to the tube plate by a threaded joint.

Referring now to FIG. 13, there is depicted an arrangement for securing the premix tubes 30 to the tube plate 34 using threaded joints 84, 86. In this embodiment, the wall surfaces of the tube plate bounding and defining the nozzle openings 35 are internally threaded and a portion of the external surface of the forward end 31 of each of the premix tubes 30 is externally threaded whereby the forward end 31 of each premix tube 30 may be threaded into a corresponding one of the nozzle openings 35 thereby securing the premix tube 30 to the tube plate 34. To ensure that a premix tube 30 does not unintendedly "back out" of the tube plate 34 during operation of the combustor, the premix tube 30 may be tack welded to the tube plate 34 after being threaded into the nozzle opening 35, for example by tack welding the lip 80 to the undersurface 39 of the tube plate 34, or by pin set screws, or by safety wire or other mechanical means.

The threaded joint 84 is formed between the centrally disposed inner premix mix tube 30, shown at the viewer's left in FIG. 13 and the tube plate 34. The threads on the external surface of the forward end 31 of the inner premix tube 30 are formed in the external surface of the premix tube forwarded of the lip 80 and somewhat aft of the forward edge 37 of the forward end 31 of the premix tube. Thus, the threaded joint 84 between the inner premix tube 30 and the tube plate 34 is formed aft of the forward edge 37 of the forward end 31 of the premix tube. A threaded joint 86 is formed between each of the outer premix tubes 30 disposed in the ring of premix tubes 30, represented by the premix tube 30 shown at the viewer's right in FIG. 13, and the tube sheet 34. The threads on the external surface of the forward end 31 of each outer premix tube 30 in the ring are formed in the external surface of the premix tube forwarded of the lip 80 and somewhat aft of the forward edge 37 of the forward end 31 of the premix tube. Thus, the threaded joint 86 between each outer premix tube 30 in the ring of premix tubes and the tube plate 34 is also formed aft of the forward edge 37 of the forward end 31 of the premix tube.

The reach of the forward ends 31 of the premix tubes 30 into the nozzle openings 35 is limited by the positioning of the lips 80 on the premix tubes. When the forward ends 31 of the premix tubes 30 are threaded into the respective nozzle openings 35, the reach into the respective nozzle opening is limited upon contact of the forward face of the lip 80 with the undersurface 39 of the tube plate 30. The lips 80 may be located relative to the forward edge 37 of the forward end 31 of the premix tube to limit the reach of the premix tube 30 as desired. For example, in the embodiment depicted in FIG. 13, the reach of the forward end 31 of the central inner premix tube into the central nozzle opening is limited such that the forward edge 37 of that premix tube does not extend to the forward face of the tube plate 34, but rather is positioned aft of the forward edge 37. However, the forward end 31 of each of the outer premix tubes extends into its respective nozzle opening 35 such that its forward edge 37 is flush or nearly flush with the forward face of the tube plate 34. Irrespective of the relative positioning of the forward edge 37 of the premix tubes 30 with respect to the forward face of the tube plate 34, the inner premix tube and each outer premix tube 30 are secured to the tube plate 34 by the threaded joints 84, 86, respectively, aft of the forward edge 37 of the forward end 31 of the premix tube and the forward edges 37 of the premix tubes 30 do not contact the tube plate 34. Additionally, the nozzle openings 35 through the tube plate 34 and the associated nozzle guides 50 may be aligned such that when the forward end 31 a premix tube 30 is inserted into a nozzle opening 35 there is no aerodynamically unacceptable step in the premix gas flow path.

The terminology used herein is for the purpose of description, not limitation. Specific structural and functional details disclosed herein are not to be interpreted as limiting, but merely as basis for teaching one skilled in the art to employ the present invention. Those skilled in the art will also recognize the equivalents that may be substituted for elements described with reference to the exemplary embodiments disclosed herein without departing from the scope of the present invention.

While the present invention has been particularly shown and described with reference to the exemplary embodiments as illustrated in the drawing, it will be recognized by those skilled in the art that various modifications may be made without departing from the spirit and scope of the invention. Therefore, it is intended that the present disclosure not be limited to the particular embodiment(s) disclosed as, but that the disclosure will include all embodiments falling within the scope of the appended claims.

We claim:

1. A combustor liner cap assembly for use in a multiple fuel nozzle combustor of a gas turbine comprising:

a tube plate having a plurality of fuel nozzle openings;

a plurality of open ended premix tubes associated with said plurality of fuel nozzle openings, each premix tube having a forward end having a forward edge, the forward end of each premix tube secured to the tube plate away from the forward edge of the forward end of the premix tube; and a plurality of nozzle guides, each one of the plurality of nozzle guides being associated with a respective one of the plurality of open ended premix tubes and being fixed thereto with a retaining member the plurality of nozzle guides being in floating relationship to the tube plate.

2. The combustor liner cap assembly as recited in claim 1 wherein each premix tube is metallurgically bonded to the tube plate aft of the forward edge of the forward end of the premix tube.

3. The combustor liner cap assembly as recited in claim 2 wherein each premix tube is welded to the tube plate.

4. The combustor liner cap assembly as recited in claim 2 wherein each premix tube is brazed to the tube plate.

5. The combustor liner cap assembly as recited in claim 1 wherein each premix tube is threaded into the tube plate.

6. The combustor liner cap assembly as recited in claim 1 further comprising:

a substantially cylindrical, longitudinally extending sleeve having a forward end and an aft end, the tube plate fixed to the forward end of the sleeve; and an aft plate fixed to the aft end of the sleeve and having a plurality of fuel nozzle openings, each fuel nozzle opening receiving an aft end of a corresponding one of the plurality of premix tubes in a sliding relationship.

7. A combustor liner cap assembly for use in a multiple fuel nozzle combustor of a gas turbine comprising:

a substantially cylindrical, longitudinally extending sleeve having a forward end and an aft end;

a tube plate fixed to the forward end of the sleeve, said tube plate having a plurality of fuel nozzle openings;

a plurality of open ended premix tubes extending aft from the tube plate, each premix tube having a forward end having a forward edge and a radial flange extending about the forward end of the premix tube, the forward end received in a corresponding one of the fuel nozzle openings and extending beyond a forward face of the tube plate, each premix tube fixed to the tube plate aft of the forward edge of the forward end of the premix tube; and a plurality of open ended nozzle guides each having a radial flange, each one of the plurality of open ended nozzle guides being associated with a respective one of the plurality of premix tubes; and a plurality of retaining members, each of the plurality of retaining members being associated with a respective one of each premix tube and nozzle guide assembly, each retaining member having a longitudinally extending leg mounted to the radial flange on the forward end of the premix tube and a tip flange extending radially over the radial flange of the nozzle guide.

8. The combustor liner cap assembly as recited in claim 7 wherein the radial flange of each premix tube has a face surface flush with a face surface of the premix tube and an under surface.

9. The combustor liner cap assembly as recited in claim 8 wherein the forward end of each premix tube extends beyond the forward face of the tube plate by a distance of at least about 12.7 millimeters (about 0.5 inch) as measured from the under surface of the radial flange of the premix tube to the forward face of the tube plate.

10. The combustor liner cap assembly as recited in claim 9 wherein the forward end of each premix tube extends beyond the forward face of the tube plate by a distance ranging from about 12.7 millimeters (about 0.5 inch) to about 25.4 millimeters (about 1.0 inch) as measured from the under surface of the radial flange of the premix tube to the forward face of the tube plate.

11. The combustor liner cap assembly as recited in claim 10 wherein each premix tube is welded to the tube plate.

12. The combustor liner cap assembly as recited in claim 8 wherein the first end of each nozzle guide is assembled in floating relationship in abutment with a corresponding one of the plurality of premix tubes.

13. A combustor liner cap assembly for use in a multiple fuel nozzle combustor of a gas turbine comprising:

a substantially cylindrical, longitudinally extending sleeve having a forward end and an aft end;

a tube plate fixed to the forward end of the sleeve, said tube plate having a forward face, a plurality of fuel nozzle openings, a plurality of first countersunk surfaces in the forward face, each first countersunk surface surrounding a corresponding one of the plurality of fuel nozzle openings, and a plurality of second countersunk surfaces, each second countersunk surface formed within a corresponding one of the plurality of first countersunk surfaces and surrounding a corresponding one of the plurality of fuel nozzle openings;

a plurality of open ended premix tubes extending aft from the tube plate, each premix tube having a forward end having a forward edge, the forward end received in a corresponding one of the fuel nozzle openings and disposed with the forward edge flush with the first countersunk surface in the forward face of the tube plate, each premix tube brazed to the tube plate along an interface of the premix tube and the tube plate between an aft surface of the tube plate and the second countersunk surface.

14. The combustor liner cap assembly as recited in claim 13 wherein each of the plurality of second countersunk surfaces is formed as a chamfer relative to a corresponding one of the plurality of the first countersunk surfaces.

15. The combustor liner cap assembly as recited in claim 13 wherein each premix tube includes a radially outwardly directed circumferentially extending lip located aft of the forward end of the premix tube, the lip having a face surface abutting the aft surface of the tube plate.

16. The combustor liner cap assembly as recited in claim 13 further comprising a plurality of open-ended nozzle guides, each nozzle guide having a first end having a radial base flange, the first end of each nozzle guide assembled in floating relationship in abutment with a corresponding one of the plurality of first countersunk surfaces.

17. The combustor liner cap assembly as recited in claim 16 further comprising a plurality of retaining plate sectors secured to the tube plate, each retaining plate sector disposed between a corresponding pair of nozzle guides and overlaps a portion of the radial base flange of each of the corresponding pair of nozzle guides.

18. A combustor liner cap assembly for use in a multiple fuel nozzle combustor of a gas turbine comprising:

a tube plate having a plurality of fuel nozzle openings, the nozzle openings being threaded; and a plurality of open ended premix tubes associated with said plurality of fuel nozzle openings and extending from the tube plate, each premix tube being threaded on a forward end, the forward end having a forward edge, the forward end received in a corresponding one of the fuel nozzle openings and secured to the tube plate by a threaded connection away from the forward edge of the forward end of the premix tube.

19. The combustor liner cap assembly as recited in claim 18 further comprising a plurality of open-ended nozzle guides, each nozzle guide disposed in abutment with a corresponding one of the plurality of nozzle openings.

* * * * *